US006300853B1

(12) United States Patent
Gräfenhahn et al.

(10) Patent No.: US 6,300,853 B1
(45) Date of Patent: Oct. 9, 2001

(54) DEVICE WITH AXIALLY POSITIONABLE COIL WINDING

(75) Inventors: Rudolf Gräfenhahn, Ursensollen; Georg Kramer, Kümmersbruck, both of (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/720,471

(22) PCT Filed: Aug. 3, 1999

(86) PCT No.: PCT/DE99/02372

§ 371 Date: Dec. 22, 2000

§ 102(e) Date: Dec. 22, 2000

(87) PCT Pub. No.: WO00/10187

PCT Pub. Date: Feb. 24, 2000

(30) Foreign Application Priority Data

Aug. 14, 1998 (DE) ..... 198 36 998

(51) Int. Cl.[7] ..... H01H 9/00

(52) U.S. Cl. ..... 335/176; 335/42; 335/172; 335/174

(58) Field of Search ..... 335/21, 38, 42, 335/172, 174, 175, 176

(56) References Cited

U.S. PATENT DOCUMENTS 4,939,492 * 7/1990 Raso, et al. ..... 335/42
5,793,026 * 8/1998 Kolberg, et al. ..... 335/172

FOREIGN PATENT DOCUMENTS

T2-68909431 5/1994 (DE) .
A1326449 8/1989 (EP) .

* cited by examiner

*Primary Examiner*—Ramon M. Barrera

(57) ABSTRACT

An adjusting ring includes a surface which is matched to the pitch of the winding wire. This adjusting ring is used in a device having a coil winding. As such, the coil winding can be positioned in its axial direction.

12 Claims, 2 Drawing Sheets

DEVICE WITH AXIALLY POSITIONABLE COIL WINDING

This application is the national phase under 35 U.S.C. § 371 of PCT International Application No. PCT/DE99/02372 which has an International filing date of Aug. 3, 1999, which designated the United States of America.

FIELD OF THE INVENTION

The invention relates to an overcurrent release having a U-shaped yoke, a coil winding, a pole and an armature, with there being an airgap between the pole and the armature and the coil winding being arranged between the two limbs of the yoke.

BACKGROUND OF THE INVENTION

A device of this generic type is used in non-delayed overcurrent releases such as, in circuit breakers for switching and protection of motors and other loads. These non-delayed overcurrent releases are designed as electromagnetic releases, which essentially include a coil winding, a coil former, an armature, a pole, a plunger, a restraining spring and a yoke. The armature pulls in at a specific circuit breaker rated current, for example at twelve times the rated current for motor protection or at 19 times the rated current for transformer protection. The armature movement in the process acts on a switch mechanism and on a moving switching piece, in order to open the contacts. According to the Standard (IEC60947), the response current must not fluctuate by more than ?20% in this case.

If the adjustment ranges are relatively wide, it is difficult to position the coil winding accurately this is because of to the relatively large supporting cross-sections required, the relatively small numbers of turns, the relatively wide tolerances for the coil and the winding wire and the relatively inhomogenous magnetic field associated with this. Thus, it is difficult; and to position the coil winding sufficiently accurately with respect to the airgap between the armature and the pole in order to make it possible to comply with the response limits in accordance with the Standard. Furthermore, there is a problem in fixing the coil winding in the position with respect to the airgap once this has been determined so that the coil winding is not moved in the direction of the center of gravity of the iron at the rated current or in the event of high short-circuit current; or with the coil being compressed or deformed as a consequence, it often results in no longer complying with the response limits.

For relatively low switching ratings; the coil winding is wound on a coil former. At the upper and lower ends, the coil former is provided with a flange, against which the winding wire rests. Furthermore, the coil formers are generally wound with a number of layers, and the last layer is bound with adhesive tape in order to fix it The coils thus form a compact unit, avoiding the problems mentioned above.

For higher switching ratings, the coils are produced with the winding turns resting on them in order to prevent the coil from being compressed and deformed in the event of high short-circuit currents.

Owing to the use of standard coil formers for the respective size and the fact that they are designed for the geometrically largest coil winding, there is often a gap between the coil former flange or yoke and the last turn of the coil winding. Once the coil winding has been positioned accurately with respect to the airgap between the armature and the pole, one end of the winding is bonded to the coil former flange or yoke in order to fix the coil winding, and the other end of the winding is welded to a connection.

SUMMARY OF THE INVENTION

The invention is based on the object of providing a device having a coil winding which allows the coil winding to be positioned in its axial direction.

The object is achieved by providing an adjusting ring between the coil winding and one of the two limbs of the yoke. This acts as a variable spacer between the coil winding and the yoke this such the position of the coil winding with respect to the airgap can be varied in the axial direction by twisting the adjusting ring.

In one advantageous development of the invention, the adjusting ring has a surface which faces the last winding turn and is matched to the pitch of the winding wire of the coil winding. This allows the coil winding to be supported over a large area toward the yoke. At the same time, the coil winding can be moved axially, with little force being required, by twisting the adjusting ring.

In addition, it is advantageous for the coil winding to be arranged on a coil former.

Inadvertent backwards twisting of the adjusting ring is prevented in a simple manner by providing the adjusting ring with teeth on its innerside which engage with teeth on the coil former.

In a further advantageous refinement, the adjusting ring is provided with an external tooth system. This allows slight movement by hand or by a production machine.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

An exemplary embodiment of the invention will be explained in the following text with reference to a drawing, in which.

DETAILED DESCRIPTION OF PREFERRED EMBODIMENTS

Figure 1:
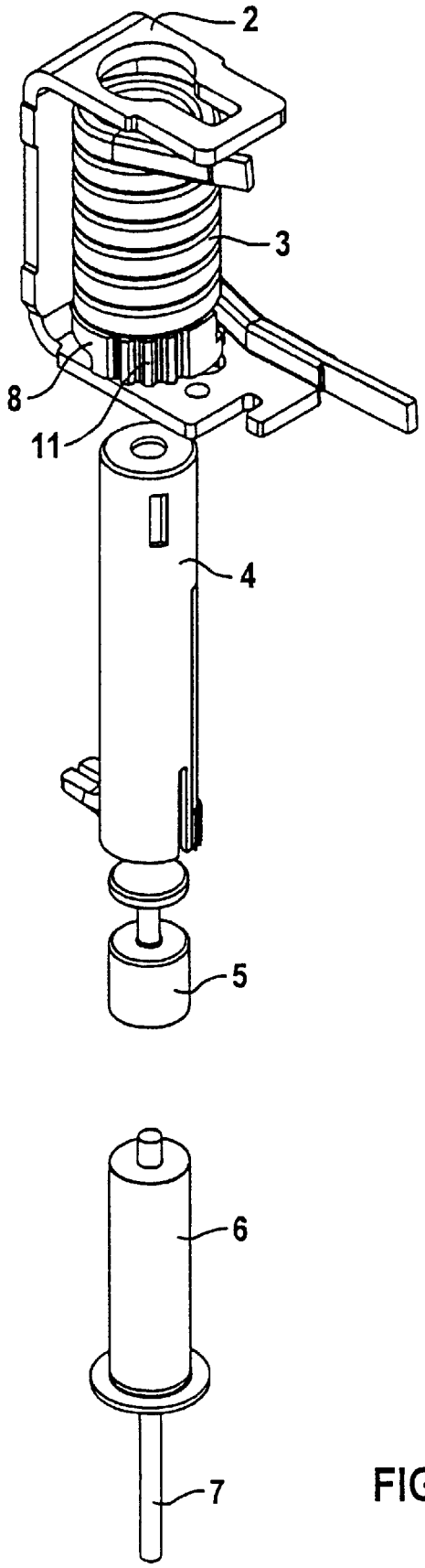
FIG. 1 shows an exploded view of an overcurrent release for a circuit breaker.

FIG. 1 shows the essential components of an overcurrent release 1 in an exploded view, as is used for circuit breakers for switching and the protection of motors and other loads. The overcurrent release 1 essentially includes a U-shaped yoke 2, a coil winding 3, a coil former 4, an armature 5, a pole 6 with an associated plunger 7, and an adjusting ring 8.

Figure 2:
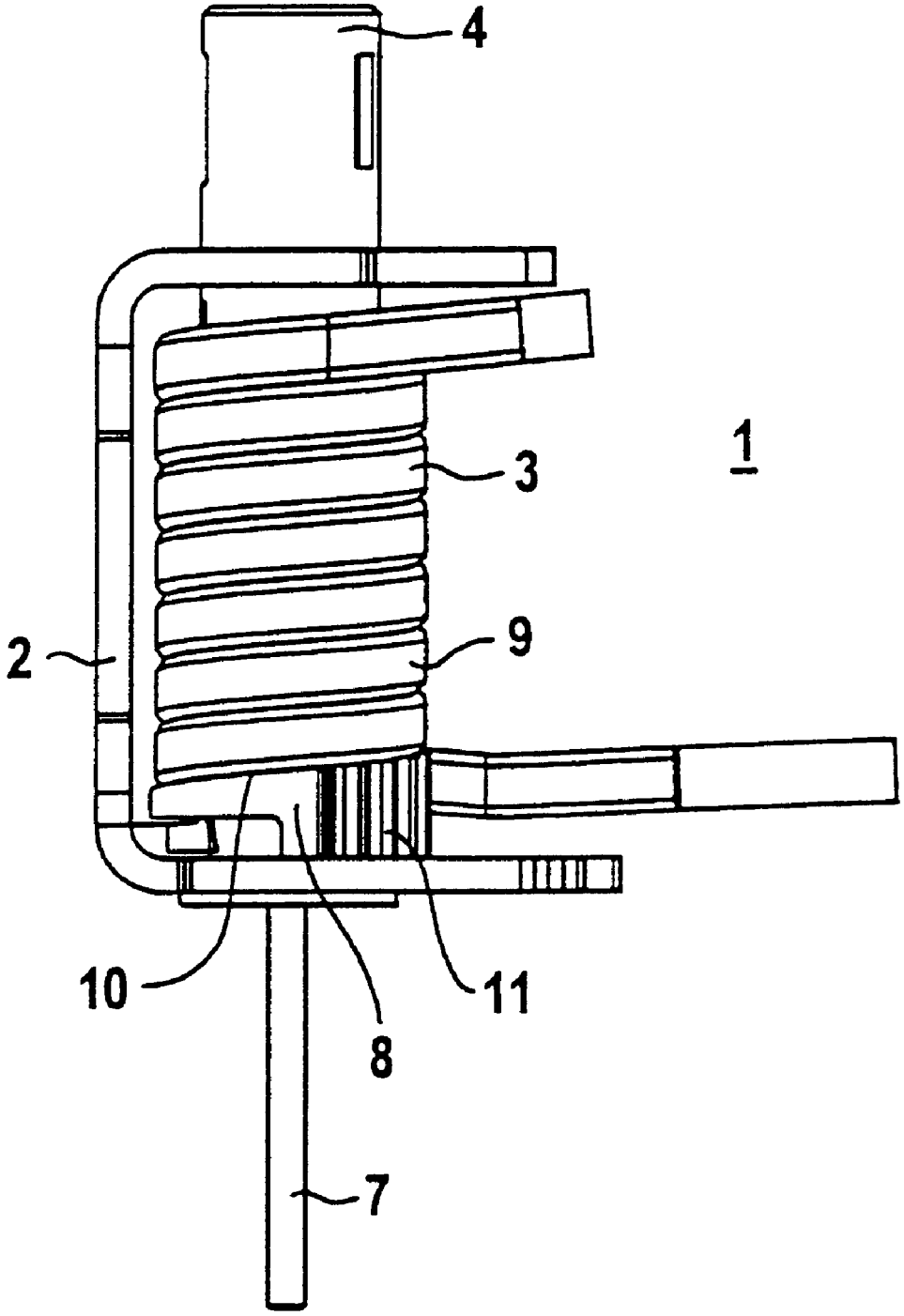
FIG. 2 shows an overcurrent release, as shown in FIG. 1, in the assembled state.

FIG. 2 shows the overcurrent release 1 in the assembled state, in which the coil winding 3 is threaded on the coil former 4, with the coil winding 3 being arranged between the two limbs of the U-shaped yoke 2, and the coil former 4 projecting through an opening in the upper limb of the yoke 2. The armature 5 and the pole 6 are located in the cavity in the cylindrical coil former 4, So that, in FIG. 2, only the plunger 7 projects downward out of the coil former

4. The adjusting ring 8 is arranged between the lower limb of the yoke 2 and the coil winding 3. This adjusting ring 8 has a surface 10 which faces the last turn 9, is matched to the winding wire pitch, and thus forms a large-area support for the coil winding 3. -On the inside, the adjusting ring 8 is preferably provided with teeth, which preferably are not shown here but which engage in teeth on the coil former 4. The coil winding 3 can be positioned accurately in the axial direction, with respect to the airgap between the armature 5 and the pole 6, by twisting the adjusting ring 8. Since the adjusting ring 2 acts as a spacer between the coil winding and the yoke 2, the coil winding is thus secured against movement. Such as internal tooth system prevents the adjusting ring 8 from being turned backwards, inadvertently. On the outer circumference, the adjusting ring 8 is preferably provided with a tooth system 11 which allows slight movement by hand or by a production machine.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed:

1. An overcurrent release comprises:

a U-shaped yoke;

a coil winding;

a pole;

an armature wherein an airgap exits between the pole and the armature, and the coil winding is arranged between two limbs of the U-shaped yoke; and an adjusting ring, provided between the coil winding and one of the two limbs of the yoke, acting as a variable spacer between the coil winding and the yoke, wherein a position of the coil winding with respect to the airgap can be varied in an axial direction by twisting the adjusting ring.

2. The overcurrent release as claimed in claim 1, wherein the adjusting ring includes an external tooth system.

3. The overcurrent release as claimed in claim 1, wherein the coil winding is arranged on a coil former.

4. The overcurrent release as claimed in claim 3, wherein the adjusting ring includes an external tooth system.

5. The overcurrent release as claimed in claim 3, wherein an inner surface of the adjusting ring includes teeth which engage with teeth on the coil former.

6. The overcurrent release as claimed in claim 5, wherein the adjusting ring includes an external tooth system.

7. The overcurrent release as claimed in claim 1, wherein the adjusting ring includes a surface which faces a last winding turn and which is matched to a pitch of a winding wire of the coil winding.

8. The overcurrent release as claimed in claim 7, wherein the adjusting ring includes an external tooth system.

9. The overcurrent release as claimed in claim 7, wherein the coil winding is arranged on a coil former.

10. The overcurrent release as claimed in claim 9, wherein the adjusting ring includes an external tooth system.

11. The overcurrent release as claimed in claim 9, wherein and inner surface of the adjusting ring includes teeth which engage with teeth on the coil former.

12. The overcurrent release as claimed in claim 11, wherein the adjusting ring includes an external tooth system.

* * * * *